US008760318B2

(12) United States Patent
Sirota et al.

(10) Patent No.: US 8,760,318 B2
(45) Date of Patent: Jun. 24, 2014

(54) METHOD FOR TRAFFIC MONITORING AND SECURE PROCESSING OF TRAFFIC VIOLATIONS

(75) Inventors: Jacobo Marcos Sirota, Takoma Park, MD (US); David Keshvar Mostofi, Chevy Chase, MD (US); Stephen John Kay, Glen Burnie, MD (US); Mario Alberto Bohorquez, Annapolis, MD (US)

(73) Assignee: Optotraffic, LLC, Lanham, MD (US)

( * ) Notice: Subject to any disclaimer, the term of this patent is extended or adjusted under 35 U.S.C. 154(b) by 358 days.

(21) Appl. No.: 13/311,792

(22) Filed: Dec. 6, 2011

(65) Prior Publication Data

US 2013/0141253 A1 Jun. 6, 2013

(51) Int. Cl.
*G08G 1/01* (2006.01)
*G08G 1/017* (2006.01)

(52) U.S. Cl.
USPC ..... 340/936; 340/937; 340/933

(58) Field of Classification Search
None
See application file for complete search history.

(56) References Cited

U.S. PATENT DOCUMENTS

| | | | | |
|---|---|---|---|---|
| 5,948,038 | A * | 9/1999 | Daly et al. | 701/117 |
| 6,546,119 | B2 * | 4/2003 | Ciolli et al. | 382/104 |
| 6,985,827 | B2 * | 1/2006 | Williams et al. | 702/142 |
| 7,248,149 | B2 * | 7/2007 | Bachelder et al. | 340/425.5 |
| 7,528,741 | B2 * | 5/2009 | Gebert | 340/937 |
| 7,986,339 | B2 * | 7/2011 | Higgins | 348/149 |
| 8,134,693 | B2 * | 3/2012 | Ciolli | 356/28 |
| 8,384,555 | B2 * | 2/2013 | Rosen | 340/686.1 |
| 2002/0141618 | A1 * | 10/2002 | Ciolli et al. | 382/104 |
| 2004/0252193 | A1 * | 12/2004 | Higgins | 348/149 |
| 2006/0055561 | A1 * | 3/2006 | Kamali et al. | 340/936 |
| 2006/0167784 | A1 * | 7/2006 | Hoffberg | 705/37 |
| 2006/0269104 | A1 * | 11/2006 | Ciolli | 382/104 |
| 2010/0128127 | A1 * | 5/2010 | Ciolli | 348/143 |
| 2011/0004513 | A1 * | 1/2011 | Hoffberg | 705/14.1 |
| 2012/0194357 | A1 * | 8/2012 | Ciolli | 340/936 |
| 2012/0229304 | A1 * | 9/2012 | Dalal | 340/936 |
| 2012/0287278 | A1 * | 11/2012 | Danis | 348/148 |
| 2013/0100286 | A1 * | 4/2013 | Lao | 348/148 |

* cited by examiner

*Primary Examiner* — Julie Lieu
(74) *Attorney, Agent, or Firm* — Miodrag Cekic; Intellectual Property Strategists, LLC

(57) ABSTRACT

A method for monitoring of traffic patterns and securely processing events of violations of traffic regulations on at least one designated surface incorporating steps of positioning at least one mobile traffic monitoring and recording module arranged to monitor traffic on at least one designated surface, to detect events of potential violations of traffic regulations, to store information pertinent to the monitored traffic and detected events of potential violations of traffic regulations, and to transmit, using a secure wireless method, at least a portion of the stored information for further processing. The method also include establishing at least one traffic information processing center arranged to securely receive and process transmitted portion of the stored information, to process received portion of the stored information pertinent to traffic regulations violations, and to generate actionable portfolio of documents for communication to subjects having interest in the processed traffic regulations violations.

19 Claims, 3 Drawing Sheets

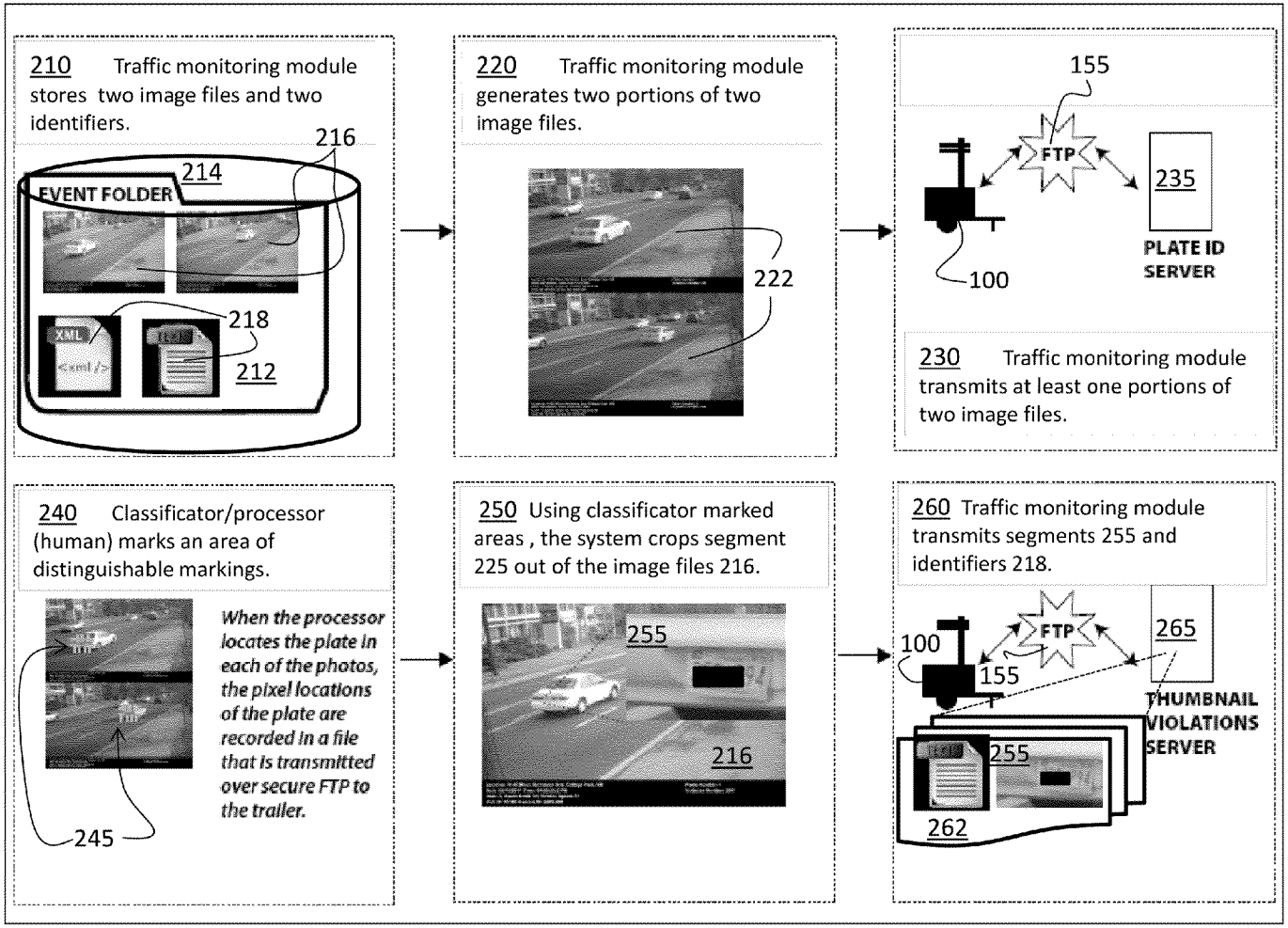
REPLACEMENT SHEET
*Figure 2*

METHOD FOR TRAFFIC MONITORING AND SECURE PROCESSING OF TRAFFIC VIOLATIONS

CROSS REFERENCE TO RELATED APPLICATIONS

This application is based upon and claims benefits of copending and co-owned U.S. patent application Ser. No. 12/546,043 entitled "MOBILE AUTOMATED SYSTEM FOR TRAFFIC MONITORING" filed with the U.S. Patent and Trademark Office on Aug. 24, 2009, which is incorporated herein by reference.

FIELD OF THE INVENTION

This invention relates to a method for monitoring traffic patterns, speed measuring, and red light enforcement on at least one designated surface supporting traffic. More particularly, the invention relates to a method for monitoring of traffic patterns and securely processing events of violations of traffic regulations on the designated surfaces.

BACKGROUND OF THE INVENTION

A method for traffic monitoring, vehicle speed determination, and traffic light violation detection and recording is disclosed. In one embodiment of the current invention, the method is arranged for monitoring traffic supported by a designated surface of a roadway, detecting individual vehicles, measuring vehicle speeds, identifying potential traffic violators, and triggering a traffic imaging device such as a camera or a video system. Different embodiments of the system can also be used by law enforcement agencies and research groups for other applications such as measurement of traffic density, monitoring vehicle speed, and studying traffic patterns. One application of particular embodiments of the current invention is to enforce red light violations. The systems of those embodiments rely on eye-safe laser radiation and scattering of such radiation off the road surface to determine the presence of a vehicle, calculate its speed, determine when a violation is likely to occur (based on predetermined criteria), and trigger the traffic imaging device for collecting evidence of the violation.

Installing traffic monitoring and photo-enforcement systems of prior art may involve digging traffic surfaces and pavements in order to install cables for interfacing the violation detecting/recording system with the traffic control devices for synchronization. Such an arrangement, for example, can make a prior art red light photo-enforcement system at least a semi-permanent installation for a specific approach at an intersection. In contrast, the disclosed exemplary methods of the current invention may not utilize wired connections between one or more mobile traffic monitoring and recording modules and at least one traffic information processing center arranged to securely receive and process transmitted portion of the stored traffic information in order to communicate the status of the monitored traffic.

In addition, for an enhancement of the security and confidentiality of the collected information, the transmitted portion of the traffic information does not include personal or other sensitive information. The method of current invention may incorporate secure wireless transfer only of traffic information which is available to general public observers at least by observation of traffic on public roads or other publicly accessible surfaces designated for public transportation.

Therefore, the methods of current invention exhibits inherent security regarding steps of transfer and subsequent processing of collected information.

Also, steps of processing of the recorded information may be optimized for human control or supervision intended to determine errors or insufficiency of transmitted portions of traffic information resulting in interruption of the processing of the transmitted traffic information before subsequent steps of obtaining and associating of personalized of proprietary information with the transmitted portion of traffic information which may further enhance security and confidentiality of information processing.

SUMMARY OF THE INVENTION

The current invention pertains to a methods for monitoring of traffic patterns and securely processing events of violations of traffic regulations on at least one designated surface including steps of positioning in a proximity the at least one designated surface at least one mobile traffic monitoring and recording module arranged to monitor traffic supported by the at least one designated surface, to detect events of potential violations of traffic regulations, to store information pertinent to the monitored traffic and detected events of potential violations of traffic regulations, and to transmit, using a secure wireless method, at least a portion of the stored information for further processing. Also, the method may include steps of establishing at least one traffic information processing center arranged to securely receive and process transmitted portion of the stored information, to process received portion of the stored information pertinent to traffic regulations violations, and to generate actionable portfolio of documents for communication to subjects having interest in the processed traffic regulations violations. The at least one mobile traffic monitoring and recording module stores recorded information pertinent to the monitored traffic and detected events of potential violations of traffic regulations into plurality of separate event folders each having at least one traffic image file and at least one identifier; and transmits at least a portion of the traffic image file and the pertinent identifier. In addition, the at least one traffic information processing center receives and stores the transmitted portion of the stored information for further processing into the actionable portfolio of documents, evaluates the received portion of the traffic image file and the at least one pertinent identifier, identifies likely events of traffic regulations violations, separates distinguishable markings out of the received portion of the traffic image file, obtains additional information connected to the separated distinguishable marking and the pertinent identifier, and generate plurality of files in the actionable portfolio of documents in a plurality of formats arranged for communication to the subjects having interest in the processed traffic regulations violations.

BRIEF DESCRIPTION OF THE DRAWINGS

The above and other embodiments, features, and aspects of the present invention are considered in more detail in relation to the following description of embodiments shown in the accompanying drawings, in which:

FIG. 2 is an illustration of a different exemplary embodiment of a method in accordance with the present invention.

DETAILED DESCRIPTION OF THE INVENTION

The invention summarized above and defined by the enumerated claims may be better understood by referring to the following description, which should be read in conjunction with the accompanying drawings of particular exemplary embodiments. This description of the illustrated embodiment, set out below to enable one to build and use an implementation of the invention, is not intended to limit the invention, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also understand that such equivalent assemblies do not depart from the spirit and scope of the invention in its broadest form.

Figure 1:
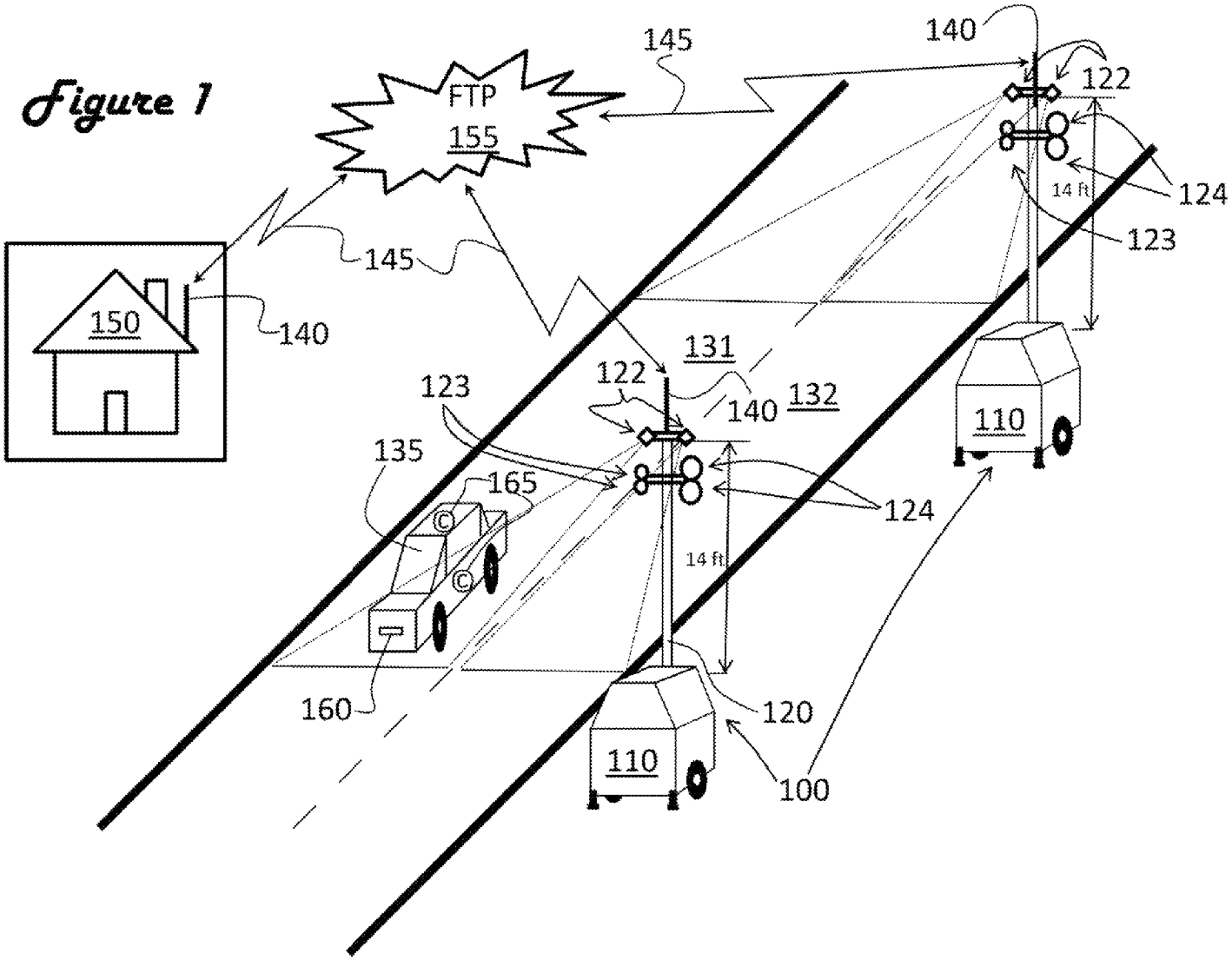
FIG. 1 is a schematic illustration of an exemplary embodiment of the present invention.

One embodiment of the current invention method pertinent to operations of one autonomous system for automated monitoring of a traffic pattern on at least one designated surface as illustrated in FIG. 1. The illustrated system includes at least one traffic monitoring and recording module 100 (two of each illustrated in FIG. 1). The traffic monitoring and recording module 100 incorporates at least one support and stabilization section 110 and at least one erector section 120. The erector section 120 may include at least one speed measuring devices 122, at least one traffic imaging device 123, and at least one illumination device 124 (two of each per module 100 illustrated in FIG. 1) erectable to respective predetermined heights relative to a designated surface 131 or 132. The designated surface 131 or 132 is arranged to support surface traffic of traffic participants 135 and may include, for example, a surface of a roadway, a surface of a parking lot, a ground traffic supporting surface of an airport, or a traffic supporting surface inside structures exemplified by factory halls, sport arenas, or other structures supporting traffic.

In addition, the traffic monitoring and recording module 100 incorporates at least one antenna 140 enabling secure communication connections 145 with at least one at traffic information processing center 150 via a Transmission Control Protocol (an alternative name Transfer Control Protocol having common customary acronym TCP)-based communication network represented in FIG. 1 by Internet network 155 using, for example, a version of secure File Transfer Protocol (FTP).

The at least one traffic information processing center 150 of the FIG. 1 illustrated exemplary embodiment may be arranged to securely receive at least a portion of the traffic-related information acquired by and stored in any of associated traffic monitoring and recording modules 100.

In addition, the at least one traffic information processing center 150 may be configured to store the received portion of the traffic-related information, to process at least a part of received portion of the stored traffic-related information pertinent to traffic regulations violations, and to generate actionable portfolio of documents for communication to subjects having interest in the processed traffic regulations violations.

The at least one mobile traffic monitoring and recording module 100 of the illustrated embodiment may store recorded information pertinent to the monitored traffic participants 135 involved in detected events of potential violations of traffic regulations into plurality of separate event folders each having at least one traffic image file and at least one identifier, and/or transmits at least a portion of the traffic image file and the pertinent identifier.

In the above exemplary embodiment, as illustrated in FIG. 1, the at least one traffic information processing center 150 may function by receiving and storing the portion of the traffic-related information transmitted via secure communication connections 145 using, for example, the Internet network 155, storing the transmitted information for further processing into the actionable portfolio of documents. Processing and evaluating the received portion of the traffic-related information, may include processing a portion of a traffic image file and at least one pertinent identifier, identifying likely events of traffic regulations violations, and separating distinguishable markings. The distinguishable markings may include, for example, a license plate 160 or other distinguishing markings 165 (which may include, but are not limited to, characteristic alphanumeric strings and combinations; characteristic graphic symbols and/or signs; courts of arms; official federal, state, or local government identifiers; graphic and/or light-emitting identifiers of long-term or temporary emergency response vehicles and/or equipment; military insignia and/or identifiers; and combinations of the listed insignia and identifiers. It may be noted that a timely identification (or, conversely, a failure to make a reliable identification) of distinguishing markers like 160 or 165 may significantly influence further processing of collected information resulting in a more efficient or more secure handling of publicly-available or privileged (e.g. personalized) information.

Several features of the processing method in accordance with another embodiment of current invention may be deduced from the illustrations in FIG. 2. The schematics presented in FIG. 2 illustrate aspects the exemplary processing method visualizing more explicitly information securely exchanged wirelessly between the traffic monitoring and recording modules 100 and traffic information processing center 150.

In accordance with the exemplary method illustrated in FIG. 2, in the step 210 at least one mobile traffic monitoring and recording module 110 stores recorded information pertinent to the monitored traffic and detected events of potential violations of traffic regulations into a plurality of separate event folders 212 stored on at least one local memory storage unit 214. Each one of the separate event folders 212 may incorporate at least one traffic image file 216 and at least one identifier 218.

In the step 220, the traffic monitoring and recording module 110 generates at least two portions 222 of two image files 216.

In the step 230 traffic monitoring and recording module 110 securely transmits at least one portion 222 of the traffic image file 216 and the at least one pertinent identifier 218 and retains recorded information pertinent to the monitored traffic and detected events of potential violations of traffic regulations into the plurality of separate event folders each having at least one traffic image file 216 and at least one identifier 218. In the method of illustrated embodiment, the secure transmission utilizes an Internet network 155 using, for example, an appropriate version of secure FTP protocol to communicate with a plate ID server 235 of the at least one traffic information processing center 150. The at least one traffic information processing center 15C receives and stores portions of the stored information transmitted by the module 100, for example, in designated memory module of the at least one plate ID server 235 for further processing into at least one actionable portfolio of documents 262.

It may be noted that the step 230 disclosed transmission of at least one portion 222 of the traffic image file 216 and the at least one pertinent identifier 218 may be made inherently secure at least by selection and generation of the portion 222 so as to include only publically-available information and filter out any feature containing personalized, privileged, and/ or protected information. Therefore, no sensitive information may be lost and potentially abused in an event where any of the portions 222 may have been maliciously or accidently intercepted or misdirected during the transfer.

Subsequent step 240 of the exemplary method of FIG. 2 involves actions of at least one human classificator who inspects one portion 222 of the traffic image file 216 and the at least one pertinent identifier 218 before further processing may be conducted. Several distinct features may result from the human involvement in the process before many subsequent (machine performed or initiated by human participants) steps are elected to proceed. One of the features pertains to the additional safety inherent to the methods of the embodiments of current invention resulting from the sophistication and flexibility of the classificators' actions authorized to interrupt the processing, suspend further action or communication, and/or obliterate transmitted information if any privileged or proprietary contain is detected inspire of all processes and precautionary actions taken previously in order to prevent or eliminate transfers of such information. As one example, the classificator may eliminate segments or entire content of the transmitted image files portions 222 containing (accidently or unavoidably) renderings or reflections of protected and/or personal nature pertinent to travelers inside a vehicles, their personal possessions, protected or privileged objects and parts, designs, documents, or any other non-public information. By such an action, any undesirable proliferation, additional communication, or storage of copies or versions of the privileged information (e.g. similar, distinct from, or unrelated to the above example) may be avoided. One may remark that some traffic monitoring processes of prior art may include step of human supervision, which is, almost as a rule, applied to final or intermediate products of various methods of a computer-assisted ("automatic") traffic data processing and is directed toward avoidance of prosecution of "false" or at least insufficiently supported traffic violation.

In subsequent actions of the step 240 of FIG. 2, the classificator may classify likely events of traffic regulations violations, marks at least one area 245 of the portion of traffic image containing distinguishable markings or interrupts further processing when contents of the traffic image file and the at least one pertinent identifier have been determined insufficient for further processing. In addition the classificator may reevaluate the received portion 222 of the traffic image file 216 and may identify at least one additional pertinent identifier, identifies likely events of traffic regulations violations, separates identified distinguishable markings out of the received portion of the traffic image file, obtains additional information connected to the separated distinguishable marking and the pertinent identifier, and generate plurality of record files in the actionable portfolio of documents 262 in a plurality of formats arranged for communication to at least some of subjects having interest in the processed traffic regulations violations.

While performing the above action, the classificator may provide instructions, obtain and utilize outputs, or remotely interact (e.g. in nearly real time) with data processing systems (computers or CPUs) associated and/or collocated with the traffic monitoring and recording modules 100, which may be structured and programmed to (step 250), using the at least one marked area 245, to locate and automatically crop segments 255 of the full resolution image files 216 (for example in a JPEG format).

In some embodiments, the processing subsystems of the traffic monitoring and recording modules 100 may obtain classificatory-marked areas 245 and crop associated segments 255 out of full resolution image files 216. For one example, less than 5 MB segments 255 of interest preserve the image resolution of the initial 15 MB JPEG image files 216, while no more than 5 MB of segments 255 (in addition to no more than 5 kB XML text files of the identifiers 218) may ever be transferred between the module 110 and the processing center 155 via the Internet network 155 and stored in the actionable portfolio of documents 262 of a violation server 265(step 260 of FIG. 2).

It may be noted that, in addition to the inherent efficiency of the aforementioned (e.g. FIG. 2) process and time saving resulting from selective secure transfer of information of interest via the Internet network 155, the disclosed method in accordance with the present invention incorporates additional safety features resulting from selective transfer of publicly available information, without systematic or accidental association or transfer of privileged or protected information, via a public network inherently open (at least by the virtue of its public character) to the unauthorized access of potentially malevolent parties.

Figure 3:
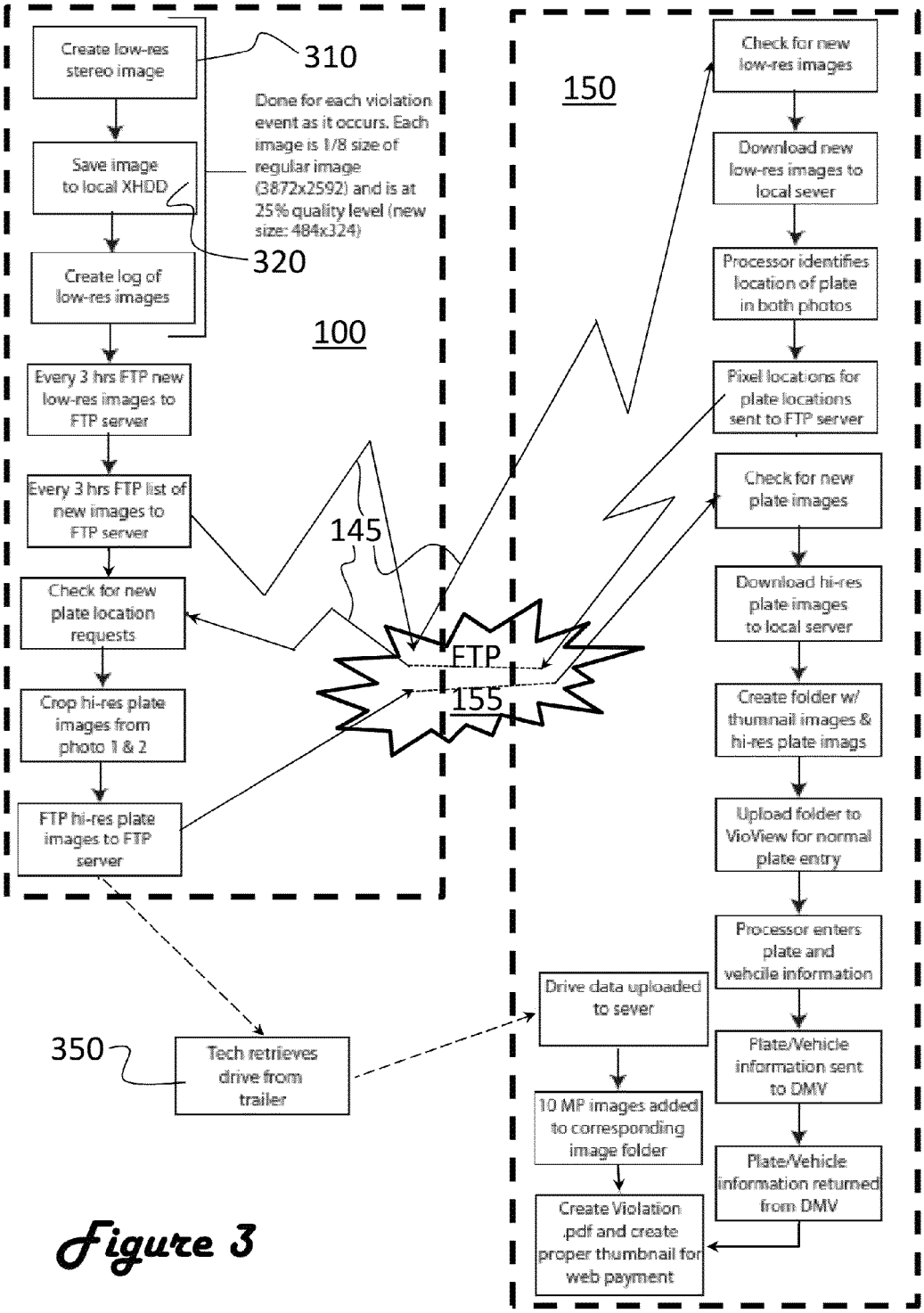
FIG. 3 is a flow chart illustration of yet another embodiment of a method in accordance with the present invention.

Another embodiment of the method in accordance win one embodiment of the present invention is illustrated schematically in FIG. 3. The illustrated method is composed for relative simplicity of implementation using generic commercial equipment and substantial involvement of personalized control and participation. It should be noted that in other embodiments of the presented method several steps may be preprogrammed for additional functionality and expedience.

In the exemplary embodiment of the FIG. 3, step 310 (performed at traffic monitoring and recording modules 100) corresponds to creation of two "low-res stereo images" of each suspected traffic violation resulting in two portions 222 having 484×324 pixels out of original traffic image (3872×2592 pixels) files 216. Furthermore, in this exemplary embodiment the portions 222 are further JPEG compressed to 25% JPEG quality level to create so-called "thumbnail image". It may be noted that, in different embodiments, different sizes, compression algorithms, and/or quality levels may be used as preset options or optimizable combinations.

In addition, the flowchart in FIG. 3 recites transfers of newly generated "low-res images" every 3 hours via the internet network 155 to the processing center 150. Again, it should be noted that, in different embodiments different transfer schedules ranging from essentially continuous transfer to occasional transfer, may be utilized depending upon, for example, different traffic patterns and conditions, different light and whether conditions, or different choices and priorities as defined by potential users.

It may also be indicated that the step 350 pertinent to recovery of complete data set recorded by the traffic monitoring and recording modules 100 depends upon particular embodiments arrangements for long-term data collection and storage. As evident from the FIG. 3, the step 350 allows for an alternative path of data flow complementary to the data flow via the internet network 155. Thus, the step 350 may be omitted in some embodiments, or may be performed differently in different embodiment, or substituted by different steps (or one step) including (but not limited to) steps of encryption and wireless transfer of encrypted data, usage of dedicated secure wired communication channels, or even intermediately transferring to and storing of data on storable media at a storing facility for subsequent use or record keeping.

Also, the schematic of method illustrated in FIG. 3 indicates that pertinent apparatus for performing the illustrated method incorporates an exchangeable (e.g. external) hard disk drive (XHDD) arranged as the at least one local memory storing unit. It may be evident that different embodiments may incorporate different storage devices including but not limited to: removable electromagnetic disk memory unit, removable electromagnetic tape memory unit, removable optical disk memory unit, removable external and internal solid state memory units, and combination units incorporating different combinations of the listed devices. Therefore, information pertinent to the monitored traffic and detected events of potential violations of traffic regulations may be stored on the at least one local memory storing unit in the at least one event folder that may include at least two JPEG traffic image files and at least one identifier incorporates at least one text file and at least one XML file. In particular embodiments wherein the at least two JPEG traffic image files may be arranged not to exceed 15 MB in total size, while the at least one text file and at least one XML file not to exceed 2 kB in total size.

Furthermore, the system for utilization of the processes as illustrated in FIGS. 2 and 3 may incorporate a communication subsystem configured for the secure communicated over a public computer network system using a secure FTP protocol such that the transmitted portion of the stored information for further processing does not include personal- or privileged information.

Finally, it may be of interest to reiterate that systems and methods in accordance with the present invention may require at least one human classificatory charged, inter alia, to inspect the received portion of the traffic image file and the at least one pertinent identifier, classifies likely events of traffic regulations violations, marks at least one area of the portion of traffic image containing distinguishable markings or interrupts further processing when contents of the traffic image file and the at least one pertinent identifier have been determined insufficient for further processing.

The present invention has been described with references to the exemplary embodiments arranged for different applications. While specific values, relationships, materials and components have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with such underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

We claim:

1. A method for monitoring of traffic patterns and securely processing events of violations of traffic regulations on at least one designated surface comprising:

a) positioning in a proximity the at least one designated surface at least one mobile traffic monitoring and recording module arranged:

to monitor traffic supported by the at least one designated surface, to detect events of potential violations of traffic regulations, to store information pertinent to the monitored traffic and detected events of potential violations of traffic regulations, and to transmit, using a secure wireless method, at least a portion of the stored information arranged to include only publically-available information and filter out any feature containing personalized or privileged information for further processing;

b) establishing at least one traffic information processing center arranged;

to securely receive and process transmitted portion of the stored information, to process received portion of the stored information pertinent to traffic regulations violations, and to generate actionable portfolio of documents for communication to subjects having interest in the processed traffic regulations violations;

wherein the at least one mobile traffic monitoring and recording module stores recorded information pertinent to the monitored traffic and detected events of potential violations of traffic regulations into plurality of separate event folders each having at least one traffic image file and at least one identifier; and transmits at least a portion of the traffic image file and the pertinent identifier; and wherein the at least one traffic information processing center receives and stores the transmitted portion of the stored information for further processing into the actionable portfolio of documents, evaluates the received portion of the traffic image file and the at least one pertinent identifier, identifies likely events of traffic regulations violations, separates distinguishable markings out of the received portion of the traffic image file, obtains additional information connected to the separated distinguishable marking and the pertinent identifier, and generate plurality of files in the actionable portfolio of documents in a plurality of formats arranged for communication to the subjects having interest in the processed traffic regulations violations.

2. The method of claim 1, wherein information pertinent to the monitored traffic and detected events of potential violations of traffic regulations is stored on at least cane local memory storing unit.

3. The method of claim 2, wherein the at least one local memory storing unit is chosen from a group of storing devices consisting of hard disk, removable electromagnetic disk memory unit, removable electromagnetic tape memory unit, removable optical disk memory unit, removable external and internal solid state memory units, and combination units incorporating different combinations of listed devices.

4. The method of claim 2, wherein information pertinent to the monitored traffic and detected events of potential violations of traffic regulations is stored on the at least one local memory storing unit in the at least one event folder.

5. The method of claim 1, wherein the at least one event folder includes at least two JPEG traffic image files and at least one identifier incorporates at least one text file and at least one XML file.

6. The method of claim 5, wherein the at least two JPEG traffic image files do not exceed 15 MB in total size, while the at least one text file and at least one XML file do not exceed 2 kB in total size.

7. The method of claim 5, wherein the portion of the stored information for further processing had been composed of at least a portion of the at least two JPEG traffic image files, at least a portion of the at least one XML file and at least a portion of the at least one text file.

8. The method of claim 7, wherein the portion of the stored information for further processing is communicated over a public computer network system using a secure FTP protocol.

9. The method of claim 1, wherein the transmitted portion of the stored information for further processing is optimized for the secure wireless transmission such that the transmitted portion of the stored information for further processing does not include personal or privileged information.

10. The method of claim 1, wherein the transmitted portion of the stored information for further processing is optimized for the secure wireless transmission such that the transmitted portion of the stored information for further processing does not exceed 5 MB in total size.

11. The method of claim 1, wherein at least one human classificator inspects the received portion of the traffic image file and the at least one pertinent identifier, classifies likely events of traffic regulations violations, marks at least one area of the portion of traffic image containing distinguishable markings or interrupts further processing when contents of the traffic image file and the at least one pertinent identifier have been determined insufficient for further processing.

12. The autonomous system for automated monitoring of traffic patterns configured to effectuate the method of claim 1, comprising:

a) at least one mobile traffic monitoring and recording module arranged:
   - to be positioned in a proximity the at least one designated surface,
   - to monitor traffic supported by the at least one designated surface,
   - to detect events of potential violations of traffic regulations,
   - to store information pertinent to the monitored traffic and detected events of potential violations of traffic regulations, and
   - to transmit, using a secure wireless method, at least a portion of the stored information arranged to include only publically-available information and filter out any feature containing personalized, or privileged information for further processing;

b) at least one traffic information processing center arranged:
   - to securely receive and process transmitted portion of the stored information,
   - to process received portion of the stored information pertinent to traffic regulations violations, and
   - to generate actionable portfolio of documents for communication to subjects having interest in the processed traffic regulations violations;

wherein the at least one mobile traffic monitoring and recording module stores recorded information pertinent to the monitored traffic and detected events of potential violations of traffic regulations into plurality of separate event folders each having at least one traffic image file and at least one identifier; and transmits at least a portion of the traffic image file and the pertinent identifier; and wherein the at least one traffic information processing center receives and stores the transmitted portion of the stored information for further processing into the actionable portfolio of documents, evaluates the received portion of the traffic image file and the at least one pertinent identifier, identifies likely events of traffic regulations violations, separates distinguishable markings out of the received portion of the traffic image file, obtains additional information connected to the separated distinguishable marking and the pertinent identifier, and generate plurality of files in the actionable portfolio of documents in a plurality of formats arranged for communication to the subjects having interest in the processed traffic regulations violations.

13. The autonomous system for automated monitoring of traffic patterns of claim 12, wherein the at least one mobile traffic monitoring and recording module comprises at least one autonomous source of electric energy including a generator arranged such that a generator's noise intensity at a position separated by 20 ft. or more from the generator does not exceed 90 dB.

14. The autonomous system for automated monitoring of traffic patterns of claim 13, wherein the at least one autonomous source of electric energy includes at least one solar panel.

15. The autonomous system for automated monitoring of traffic patterns of claim 14, wherein the at least one solar panel is associated with at least one erector section.

16. The autonomous system for automated monitoring of traffic patterns of claim 12, wherein the at least one designated surface is a multiple lane roadway and the at least one mobile autonomous monitoring and recording module is arranged for a simultaneous uni-directional or bi-directional monitoring of at least two lanes of the multiple lane roadway.

17. The autonomous system for automated monitoring of traffic patterns of claim 12, wherein at least one designated surface includes at least two adjacent traffic lanes and the at least one mobile traffic monitoring and recording module comprises at least two speed measuring devices arranged to simultaneously measure speeds of at least two separate vehicles traveling in the at least two adjacent traffic lanes.

18. The autonomous system for automated monitoring of traffic patterns of claim 12, comprising an onboard clock and a subsystem for clock calibration against a transmitted clock signal of a Global Positioning System (GPS) satellite system.

19. The autonomous system for automated monitoring of traffic patterns of claim 12, wherein, no part of the autonomous system for automated monitoring of traffic patterns is positioned on any of at least one designated surface, no wired connections are established between the autonomous system for automated monitoring of traffic patterns and either one of local power distribution systems, local traffic control system, and local water and sewer system, and no modification is performed on either one of local power distribution systems, local traffic control system, and local water and sewer system.

* * * * *